US007230569B1

(12) United States Patent
Hules et al.

(10) Patent No.: US 7,230,569 B1
(45) Date of Patent: Jun. 12, 2007

(54) SEARCH ALGORITHM FOR PHASED ARRAY ANTENNA

(75) Inventors: Frank J. Hules, Calabasas, CA (US); Terrence L. Fall, Thousand Oaks, CA (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/317,586

(22) Filed: Dec. 23, 2005

(51) Int. Cl.
*H01Q 3/00* (2006.01)

(52) U.S. Cl. ..... 342/359; 342/74

(58) Field of Classification Search ..... 342/74, 342/75, 77, 427, 428; 343/754, 757, 758
See application file for complete search history.

(56) References Cited

U.S. PATENT DOCUMENTS 4,599,619 A * 7/1986 Keigler et al. ..... 342/352
4,630,058 A * 12/1986 Brown ..... 342/359

* cited by examiner

*Primary Examiner*—Dao L. Phan
(74) *Attorney, Agent, or Firm*—Jimmy L. Funke

(57) ABSTRACT

An antenna system electronically searches for a satellite signal by beginning at the current pointing angle of an antenna. The antenna system sweeps a tuner frequency of the receiver by electronically commanding the receiver to tune to different transponder frequencies. By scanning through transponder frequencies, the antenna system can locate a satellite signal without mechanical movement. As a result, the satellite signal can be acquired more quickly than in some conventional systems.

36 Claims, 2 Drawing Sheets

SEARCH ALGORITHM FOR PHASED ARRAY ANTENNA

TECHNICAL FIELD

This disclosure relates generally to antennas. More particularly, the disclosure relates to antennas for use in receiving satellite broadcast signals.

BACKGROUND OF THE DISCLOSURE

The vast majority of vehicles currently in use incorporate vehicle communication systems for receiving or transmitting signals. For example, vehicle audio systems provide information and entertainment to many motorists daily. These audio systems typically include an AM/FM radio receiver that receives radio frequency (RF) signals. These RF signals are then processed and rendered as audio output.

Vehicle video entertainment systems are gaining in popularity among motorists who want to provide expanded entertainment options to rear seat passengers, such as children. Rear seat passengers in vehicles equipped with video entertainment systems can watch movies or play video games to pass time during lengthy trips.

Some vehicle video entertainment systems incorporate tuners capable of receiving broadcast signals in the VHF and UHF frequency bands. Such systems allow passengers to watch broadcast television, further expanding their entertainment options. However, programming is limited to local broadcast stations. In addition, picture and sound quality is limited by the analog nature of the broadcast signals. Further, signal quality may be poor in some areas, such as remote locations.

Satellite-based broadcast systems, such as Direct Broadcast Satellite (DBS), provide subscribers with digital television programming. Because the signals used by DBS systems are digital, picture and sound quality is enhanced relative to traditional analog broadcasting systems. In addition, a DBS transmitter can provide coverage for a much larger geographic area than the terrestrial-based transmitters used by analog broadcasters. For example, it is possible to travel across a large portion of the United States without needing to change channels as different metropolitan areas are entered and exited.

A conventional DBS receiver employs a satellite tracking system to detect the position of a satellite transmitter. By orienting or pointing a receiver antenna toward the detected position, good reception can be promoted. Satellite tracking systems typically produce imperfect information to effect initial antenna pointing. To identify the correct pointing angle toward the satellite, the antenna beam is swept in azimuth and elevation or in some combination of azimuth and elevation until the strongest satellite signal is received. This beam sweeping can be produced mechanically by physically moving the antenna. Alternatively, beam sweeping can be produced electronically by adjusting the phasing of the outputs of the antenna elements or segments. Electronic beam sweeping typically produces faster response times and higher achievable slew rates than mechanical beam sweeping.

Phased array antennas are commonly employed in the design of satellite tracking systems in which a low antenna profile is sought. Additionally, with phased array antennas, beam steering may be induced by applying a phase shift between the receiving segments of the antenna. Many phased array antennas incorporate arrays of slotted waveguides or patches, e.g., 1-D patch arrays, on a common microstrip feed. Applying phase shifts between the outputs of the slotted waveguides or the 1-D patch arrays implements beam steering along a rotational plane that is orthogonal to the orientation of the slotted waveguides or the 1-D patch arrays. With this technique and in this plane of movement, essentially any pointing angle required to track a satellite can be realized.

While applied phase shifts can realize a variety of pointing angles in the plane of movement, the technique is not as readily applied to realize pointing angles in other planes. In particular, in the plane described by the signal path and the orientation of the slotted waveguides or 1-D patch arrays, phase shifts cannot easily be applied between receiving and radiating elements of the antenna. The slots in a slotted waveguide or the patches on a 1-D patch array have a fixed spacing slightly above or slightly below one wavelength of the anticipated incident frequency, and it is difficult to impart variable phase shifts between these slots or patches. As a result, the slotted waveguide or 1-D patch array exhibits a frequency-dependent pointing angle that is offset from a plane orthogonal to the orientation of the slotted waveguide or 1-D patch array. This offset may cause the system to search for the satellite in the wrong direction and track the wrong satellite, resulting in significant acquisition and reacquisition delays and poor signal quality.

One approach to adjusting the pointing angle to a higher or lower value involves dividing the slotted waveguides or 1-D patch arrays into smaller segments. Variable phase shifts are then applied to the input or output ports of the slotted waveguides or 1-D patch arrays as appropriate to the desired angular change. This design, however, involves added complexity and, as a result, increased cost.

Another alternative involves splitting the phased array antenna into two subarrays along the orientation of the slotted waveguides or 1-D patch arrays and summing and differencing pattern signals. This technique results in the formation of an angle discriminant that makes it possible to track satellites and measure pointing offsets in a way not afforded with a single beam pattern. This approach has been effective in reducing tracking error. However, the approach does not afford sufficient beam visibility to compensate for poor open loop beam positioning.

SUMMARY OF VARIOUS EMBODIMENTS

According to various example embodiments, an antenna system electronically searches for a satellite signal by beginning at the current pointing angle of an antenna. The antenna system sweeps a tuner frequency of the receiver by electronically commanding the receiver to tune to different transponder frequencies.

One embodiment is directed to an antenna system including an antenna configured to receive a signal from a satellite and a control subsystem operatively coupled to the antenna. The control subsystem is configured to command the antenna to point to an expected direction associated with one of the transponder frequencies. The control subsystem then commands the receiver to tune to selected transponder frequencies within the broadcast spectrum until a satellite signal is detected and determines an antenna beam positioning value associated with the transponder frequency at which the satellite signal was detected. A pointing error is determined as a function of the expected direction and the determined antenna beam positioning value.

In another embodiment, a vehicle communication system includes an antenna configured to receive a signal from a satellite and a control subsystem operatively coupled to the antenna. The control subsystem is configured to command the antenna to point to an expected direction associated with one of the transponder frequencies. The control subsystem then commands the receiver to tune to selected transponder frequencies within the broadcast spectrum until a satellite signal is detected and determines an antenna beam positioning value associated with the transponder frequency at which the satellite signal was detected. A pointing error is determined as a function of the expected direction and the determined antenna beam positioning value. A communication device is operatively coupled to the antenna.

Another embodiment is directed to a method to determine a pointing angle to a satellite in a satellite broadcast system using a broadcast spectrum comprising a plurality of transponder frequencies. An antenna is commanded to point to an expected direction associated with one of the transponder frequencies. A receiver is commanded to sequentially tune to selected transponder frequencies within the broadcast spectrum until a satellite signal is detected. An antenna beam positioning value associated with the transponder frequency at which the satellite signal was detected is determined. A pointing error is determined as a function of the expected direction and the determined antenna beam positioning value. This method may be embodied in a processor-readable medium storing processor-executable instructions.

Various embodiments may provide certain advantages. For instance, by scanning through transponder frequencies, the antenna system can locate a satellite signal without mechanical movement. As a result, the satellite signal can be acquired more quickly than in some conventional systems.

Additional objects, advantages, and features will become apparent from the following description and the claims that follow, considered in conjunction with the accompanying drawings.

DESCRIPTION OF VARIOUS EMBODIMENTS

According to various example embodiments, an antenna system electronically searches for a satellite signal by beginning at the current pointing angle of an antenna. The antenna system sweeps a tuner frequency of the receiver by electronically commanding the receiver to tune to different transponder frequencies. By scanning through transponder frequencies, the antenna system can locate a satellite signal without mechanical movement. As a result, the satellite signal can be acquired more quickly than in some conventional systems.

In the following description, numerous specific details are set forth in order to provide a thorough understanding of various embodiments of the present invention. It will be apparent to one skilled in the art that the present invention may be practiced without some or all of these specific details. In other instances, well known components and process steps have not been described in detail in order to avoid unnecessarily obscuring the present invention.

Some embodiments may be described in the general context of microcontroller-executable instructions, such as program modules, being stored in a microcontroller-readable medium, such as a memory, and executed by a microcontroller (MCU). Generally, program modules include routines, programs, objects, components, data structures, etc., that perform particular tasks or implement particular abstract data types.

Figure 1:
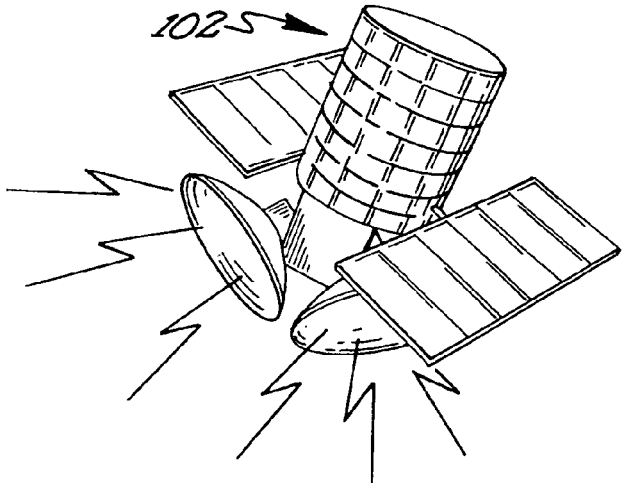
FIG. 1 is a block diagram illustrating an example communication system according to an embodiment.

Referring now to the drawings, FIG. 1 illustrates an example communication system 100, such as a vehicle entertainment system. In the communication system 100, a radio frequency (RF) signal is transmitted, for example, from a satellite transmitter 102 to an antenna 104, which may be implemented as a phased array antenna. In one embodiment, the RF signal is transmitted by a direct broadcast satellite (DBS) system. DBS systems use $K_u$-band satellites that transmit digitally-compressed television and audio signals to the Earth in what is called the Broadcast Satellite Service (BSS) portion of the $K_u$ band between 12.2 and 12.7 GHz. Due to digital compression technologies, DBS systems can deliver hundreds of cable TV-style programming channels, as well as local network television affiliates. DBS services generally offer better picture and sound quality and a greater selection of channels compared to analog cable and broadcast television. DBS services may also offer additional features, such as an on-screen guide, digital video recorder (DVR) functionality, high-definition television (HDTV), and pay-per-view (PPV) programming. In other embodiments, the satellite transmitter 102 may transmit other types of signals, such as satellite-based digital audio radio (SDAR) signals or global positioning system (GPS) signals.

The RF signal is amplified, mixed, and/or filtered by a low noise block (LNB) 106 that is operatively coupled to the antenna 104. The signal, now an intermediate frequency (IF) signal, is then conducted to an input of a receiver 108, for example, via an RF or coaxial cable 110. While not shown in FIG. 1, the IF signal may be conducted across a glass or other dielectric surface via a coupling device (not shown) that may employ capacitive coupling, slot coupling, or aperture coupling. The IF signal would then be provided to the receiver 108 via a matching circuit (not shown) connected to the coupling device. As an alternative, the RF or coaxial cable 110 may be connected to the antenna 104 through a hole drilled in the glass or other dielectric surface.

In the embodiment illustrated in FIG. 1, the antenna 104 is operatively coupled to the receiver 108. It will be appreciated by those skilled in the art that the antenna 104 can be operatively coupled to multiple communication devices. Some such communication devices may have both transmitting and receiving capabilities, and may be connected to antennas, such as transmitting antennas, other than the antenna 104. If the antenna 104 is located in a vehicle having multiple communication devices, the communication devices may be operatively coupled to the antenna via a high-speed data bus (not shown). The communication devices may include, e.g., one or more receivers in combination with one or more transmitters.

The receiver 106 is operatively coupled to a decoder 112, which decodes that RF signals received by the receiver 108. In addition, the decoder 112 may also perform an authentication function to verify that the communication system 100 is authorized to receive programming embodied in the RF signal. The decoded signal may contain audio and video components. The video component is rendered by a display 114, and the audio component is rendered by an audio subsystem 116, which may include a number of speakers (not shown).

A control subsystem including a microprocessor or microcontroller (MCU) 118 controls the operation of the antenna 104 and the receiver 108. For example, the MCU 118 controls the direction in which the antenna 104 is oriented and the frequency to which the receiver 108 is tuned. According to various embodiments, the MCU 118 controls these aspects of the operation of the antenna 104 and the receiver 108 to acquire and track a satellite signal. In particular, the broadband nature of the signal from the satellite 102 and the physics of phased array receive antennas are advantageously used to achieve greater off-beam visibility without mechanically redirecting the antenna 104.

In general, the satellite transmitter 102 uses a set of transponders having a cumulative bandwidth of 500 MHz or more. The interaction of the signals from these transponders with the antenna 104 generates several frequency dependent pointing angle sensitivities. In some conventional antenna systems, these sensitivities require the antenna to be directed to a different pointing angle for each of the satellite's transponders associated with system user selections.

When the antenna 104 of the embodiment shown in FIG. 1 is not directed toward the correct pointing angle for one transponder and the satellite signal is lost, however, the antenna 104 may still receive a relatively strong signal from another transponder at a different transponder frequency. Accordingly, the pointing error and relative direction of the satellite transmitter 102 with respect to the antenna 104 can be measured by computing the antenna beam positioning, or pointing, associated with this transponder frequency and the antenna beam positioning associated with the initial transponder frequency.

Figure 2:
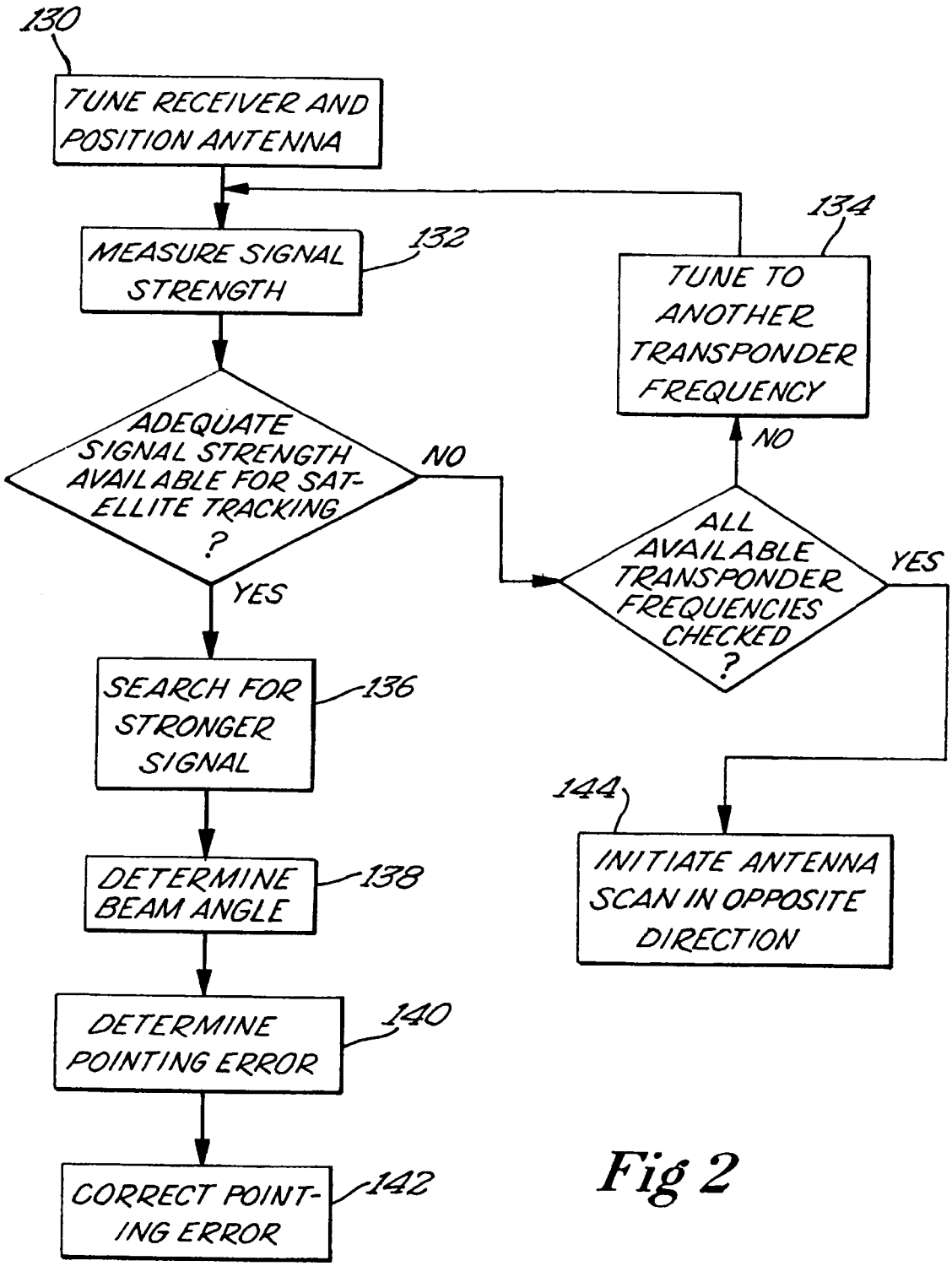
FIG. 2 is a flow diagram illustrating an example method according to another embodiment.

FIG. 2 is a flow diagram illustrating one way in which the MCU 118 can determine a pointing angle to the satellite transmitter 102. The MCU 118 tunes the receiver 108 to an initial transponder frequency selected from multiple transponder frequencies within the broadcast spectrum used by the satellite broadcast system. The MCU 118 also commands the antenna 104 to point to a direction suitable for receiving the initial transponder frequency (130). The satellite signal strength associated with the initial transponder frequency is then measured (132) using any of a number of conventional signal strength determination techniques. The presence of a strong satellite signal when the receiver 108 is tuned to the initial transponder frequency indicates that the satellite transmitter 102 is located at or near its expected direction.

On the other hand, if the signal is not strong enough to track the satellite at the initial transponder frequency, the MCU 118 commands the receiver 108 to tune to another transponder frequency (134). The signal strength at the new transponder frequency is again measured (132). The process repeats until all of the transponder frequencies have been checked, or until the signal is strong enough to track the satellite.

When the receiver 108 has tuned to a transponder frequency that produces a signal that is strong enough to track the satellite, the MCU 118 and receiver 108 check adjacent transponder frequencies for a larger measurable signal (136). The MCU 118 then selects one of the transponder frequencies as a basis for calculating the pointing error. For example, in the embodiment shown in FIG. 2, the MCU 118 selects the transponder frequency that produces the strongest signal. In some cases, however, the MCU 118 may select a different transponder frequency. For example, if the satellite transmitter 102 is known a priori to emit a spot antenna beam for certain transponder frequencies and not for others, the MCU 118 may ignore or otherwise account for transponder frequencies for which a spot antenna beam is emitted, which may produce an artificially strong signal. In such cases, a strong signal may be indicative of the nature of the spot antenna beam, rather than of optimum orientation. Accordingly, in some embodiments, the MCU 118 selects the transponder frequency that produces the strongest signal, after correcting for differences between transponders.

In any event, the MCU 118 calculates an antenna beam positioning value, e.g., a beam angle, associated with the selected transponder frequency (138). The antenna beam positioning value can be calculated using any of several mathematical relationships derived from the design implementation of the antenna 104. Broadly speaking, the angle of the antenna beam relative to the face of the antenna 104 will change as an inverse cosine function of the receive frequency and the distance or spacing between the antenna slots or other receiving elements, such as, for example, patches. Because the spacing between receiving elements is fixed by the antenna design, this mathematical relationship is predominantly sensitive to frequency. The frequency f may be expressed in terms of a corresponding wavelength λ, where $$\lambda = f/c,$$

and c is the speed of light.

Figure 3:
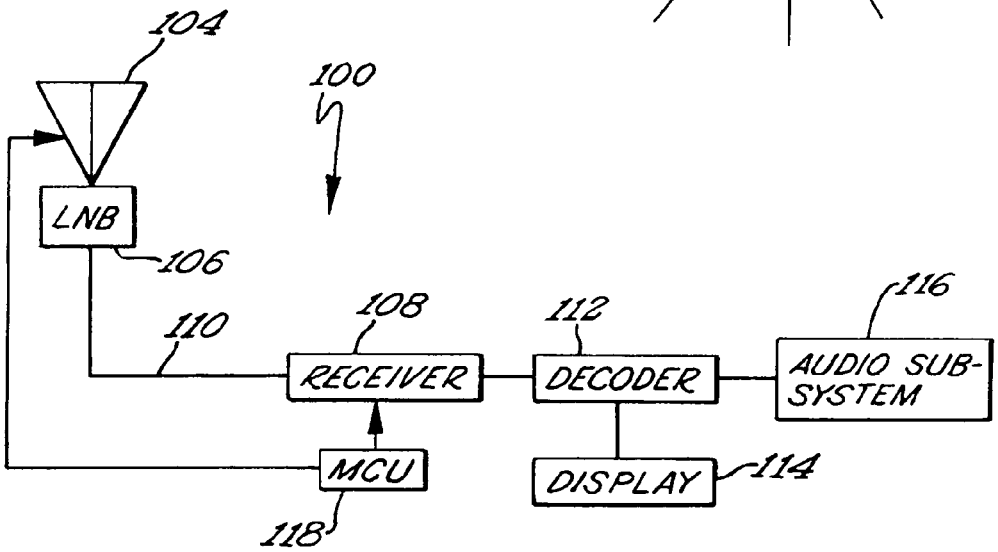
FIG. 3 is a diagram illustrating a portion of the communication system of FIG. 1 according to a particular implementation.
Figure 3:
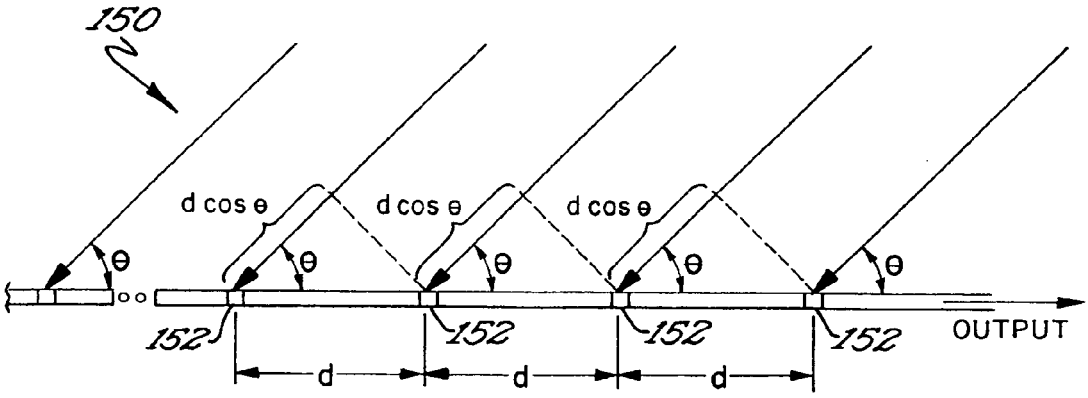

By way of illustration, FIG. 3 depicts an N-element linear array antenna 150 that may be used to implement the antenna 104. It will be appreciated by those of skill in the art that the antenna 104 may employ any of a variety of other designs, and that the particular design depicted in FIG. 3 is provided for purposes of illustration and not limitation. The linear array antenna 150 is formed by a number of linear elements 152 spaced apart by a distance d. Assuming that the linear elements 152 are uniformly weighted and spaced, the angle theta (θ) at which the antenna 150 will receive a specific frequency f is given by the following expression:

$$\theta = \cos^{-1}[(\lambda \cdot \beta)/(2 \cdot \pi \cdot d)],$$

where d is the distance between the linear elements 152 and β is a parameter representing the phase excitation difference between the linear elements 152. Both d and β are fixed by the design of the array antenna 150. However, the value of β differs slightly for different transponder frequencies. The parameter β can be quantified at the time of the array design for each of the expected transponder frequencies. To simplify calculations, however, the parameter β can be specified for the center transponder frequency only because any error resulting from not specifying the parameter β for other transponder frequencies will be small relative to the angular coverage of the receive beam pattern of the array antenna 150. With both d and β treated as constants, θ can be approximated as:

$$\theta = \cos^{-1}(K\lambda),$$

where K is a constant. Thus, if the initial transponder frequency corresponds to a wavelength $\lambda_a$, the antenna beam positioning value $\theta_a$ that corresponds to the initial transponder frequency can be approximated as $\theta_a = \cos^{-1}(K\lambda_a)$. Likewise, if the selected transponder frequency, e.g., the transponder frequency producing the maximum signal strength, corresponds to a wavelength $\lambda_b$, the antenna beam positioning value $\theta_b$ that corresponds to the initial transponder frequency can be approximated as $\theta_b = \cos^{-1}(K\lambda_b)$.

Referring again to FIG. 2, after the antenna beam positioning value is calculated (138) for the selected transponder frequency, the pointing error may be determined (140). In one embodiment, for example, the MCU 118 determines the pointing error as a function of the wavelengths $\lambda_a$ and $\lambda_b$:

$$\theta_b-\theta_a=\cos^{-1}(K\lambda_b)-\cos^{-1}(K\lambda_a)$$

This pointing error is the pointing error associated with receiving the satellite signal at the transponder frequency corresponding to the wavelength $\lambda_a$ when the satellite transmitter 102 is only visible at the transponder frequency corresponding to the wavelength $\lambda_b$.

The pointing error is then used to correct the initial pointing angle (142) of the antenna 104. Some conventional antenna systems use an inertial measurement unit (IMU, not shown) to determine the initial orientation of the antenna. By calculating the pointing error and using the calculated pointing error to acquire the signal from the satellite transmitter 102, the communication system 100 can supplement the IMU. For example, the communication system 100 may incorporate a lower quality, and less expensive, IMU than would otherwise be used to acquire the signal from the satellite transmitter 102. In this way, manufacturing costs may be reduced.

When the MCU 118 initiates the search for the satellite transmitter 102 by commanding the antenna 104 to mechanically point to an expected direction of the satellite transmitter 102, there is a 50% probability that the search will be initiated away from the position of the satellite transmitter 102. Determining the pointing error as described above allows the MCU 118 to acquire the position of the satellite transmitter 102 electronically so that the antenna 104 can lock on to the satellite signal more quickly relative to a purely mechanical searching technique. In some cases, however, the receiver 108 may be tuned to all available transponder frequencies without producing adequate signal strength to track the satellite. Accordingly, the antenna 104 may not be able to acquire the satellite signal electronically. If the antenna 104 cannot acquire the satellite signal electronically, the MCU 118 initiates a mechanical scan in the opposite direction of where it looked electronically (144), increasing the likelihood that the satellite signal will be detected. For example, if the electronic scan proceeded in a leftward direction and the antenna 104 did not acquire the satellite signal, the MCU 118 would initiate a mechanical scan in a rightward direction.

In addition to faster signal acquisition times, calculating and using the pointing error as described above to locate the satellite transmitter 102 may result in other benefits. For example, in some conventional antenna systems, IMU measurements play an important role when the tracking system loses the location of the satellite transmitter and cannot determine the correct direction in which to orient the antenna to acquire the satellite signal. Many conventional automotive antenna systems exhibit azimuth beamwidths of approximately ±1–2°. Accordingly, if a long signal fade or visual blockage causes the satellite to fall outside of this angular region of visibility, a conventional tracking system will typically lose the satellite signal. By contrast, by commanding the receiver 108 to tune to various transponder frequencies and determining the pointing error, the communication system 100 may be able to track the satellite transmitter 102 over a greater azimuth beamwidth.

This enhanced tracking can be realized using any of a number of algorithms. For example, in some cases, the satellite transmitter 102 is offset at an angle that is visible when the receiver 108 is tuned to another transponder frequency. Calculating the pointing error by tuning the antenna 104 to different transponder frequencies may allow the communication system 100 to track the satellite transmitter 102 over a greater azimuth beamwidth.

In addition, while not required, the accuracy of the acquisition of the satellite signal by the antenna 104 may be enhanced via the use of angle discriminant measurements. Angle discriminants can be formed at any position to which the antenna beam is directed. Such positions include, for example, positions associated with the various transponder frequencies. Using angle discriminant measurements can further extend the visibility range afforded by selecting transponder frequencies as described above in connection with FIG. 2. A properly implemented angle discriminant can measure pointing error up to 2° beyond that obtained with the transponder selection technique alone.

For example, if the antenna 104 is implemented as a planar array antenna, the communication system 100 may use angle discriminants resulting from subarray architectures in the construction of the antenna 104. In essence, a planar array antenna can be considered to be formed by a plurality of smaller subarray antennas, each of which is oriented in a slightly different direction. When one of these smaller subarray antennas can detect the signal from the satellite transmitter 102 more strongly than the others, the satellite transmitter 102 is determined to be in the direction of the pointing angle associated with that subarray antenna.

As another example, enhanced tracking may also be realized if the antenna design incorporates electronic beam positioning in elevation. In this case, the MCU 118 can electronically conduct a search above and below the last track angle to ascertain the new position of the satellite transmitter 102. Enhanced tracking can be realized by using any or all of the above-described algorithms, singly or in combination. In this way, the communication system 100 can reacquire a lost satellite without needing to initiate a mechanical scan or use IMU measurements.

The foregoing discussion has been primarily directed to antennas that are implemented as planar array antennas that are formed by a stack of waveguide sticks or rows of patches arranged in a similar configuration. In this configuration, the receiver elements along the waveguide sticks or within each of the rows of patches have a fixed spacing, and the pointing angle of the composite antenna beam varies with the received frequency. It should be noted that the principles described herein may be broadly applicable to other types of antennas, including, but not limited to, linear array antennas.

As demonstrated by the foregoing discussion, various embodiments may provide certain advantages. For instance, a satellite acquisition and tracking system can electronically acquire satellites at significantly larger offset angles. As a result, sensors used in the system need not be as accurate as in conventional systems, thereby potentially reducing manufacturing costs. In addition, satellite acquisition may be performed more quickly compared to conventional techniques, and the system architecture that deals with short-term blockages and fades can be simplified.

It will be understood by those skilled in the art that various modifications and improvements may be made without departing from the spirit and scope of the disclosed embodiments. The scope of protection afforded is to be determined solely by the claims and by the breadth of interpretation allowed by law.

What is claimed is:

1. An antenna system comprising:

an antenna configured to receive a signal from a satellite in a satellite broadcast system using a broadcast spectrum comprising a plurality of transponder frequencies;

a receiver operatively coupled to the antenna; and a control subsystem operatively coupled to the antenna and configured to command the antenna to point to an expected direction associated with one of the transponder frequencies;

command the receiver to tune to selected transponder frequencies within the broadcast spectrum until a satellite signal is detected;

determine an antenna beam positioning value associated with the transponder frequency at which the satellite signal was detected; and determine a pointing error as a function of the expected direction and the determined antenna beam positioning value.

2. The antenna system of claim 1, wherein the antenna comprises a phased array antenna.

3. The antenna system of claim 1, wherein the antenna comprises a linear array antenna.

4. The antenna system of claim 1, wherein the pointing error is determined at least in part by calculating a difference between the determined antenna beam positioning value and an antenna beam positioning value associated with the expected direction.

5. The antenna system of claim 1, wherein the control subsystem is further configured to, if the satellite signal is not detected, command the antenna to point to another direction.

6. The antenna system of claim 5, wherein the other direction is opposite the expected direction to which the antenna was initially pointed.

7. The antenna system of claim 1, wherein the control subsystem is further configured to determine the pointing error as a function of an angle discriminant measurement.

8. The antenna system of claim 1, wherein the control subsystem is further configured to adjust an expected direction to the satellite as a function of the pointing error.

9. The antenna system of claim 8, wherein the control subsystem is further configured to perform an electronic search for the satellite signal at a different elevation than the adjusted expected direction to the satellite.

10. The antenna system of claim 1, wherein the control subsystem is further configured to:

command the receiver to sequentially tune to the selected transponder frequencies to detect a satellite signal at a plurality of the selected transponder frequencies; and select one of the transponder frequencies at which the satellite signal was detected for determining the antenna beam positioning value.

11. The antenna system of claim 10, wherein the control subsystem is further configured to select the transponder frequency at which the detected satellite signal is at a maximum for determining the antenna beam positioning value.

12. A vehicle communication system comprising:

an antenna configured to receive a signal from a satellite in a satellite broadcast system using a broadcast spectrum comprising a plurality of transponder frequencies;

a receiver operatively coupled to the antenna;

a control subsystem operatively coupled to the antenna and configured to command the antenna to point to an expected direction associated with one of the transponder frequencies, command the receiver to tune to selected transponder frequencies within the broadcast spectrum until a satellite signal is detected, determine an antenna beam positioning value associated with the transponder frequency at which the satellite signal was detected, and determine a pointing error as a function of the expected direction and the determined antenna beam positioning value; and a communication device operatively coupled to the antenna.

13. The vehicle communication system of claim 12, wherein the antenna comprises a phased array antenna.

14. The vehicle communication system of claim 12, wherein the antenna comprises a linear array antenna.

15. The vehicle communication system of claim 12, wherein the control subsystem is further configured to, if the satellite signal is not detected, command the antenna to point to another direction.

16. The vehicle communication system of claim 12, wherein the control subsystem is further configured to determine the pointing error as a function of an angle discriminant measurement.

17. The vehicle communication system of claim 12, wherein the control subsystem is further configured to adjust an expected direction to the satellite as a function of the pointing error.

18. The vehicle communication system of claim 12, wherein the control subsystem is further configured to:

command the receiver to sequentially tune to the selected transponder frequencies to detect a satellite signal at a plurality of the selected transponder frequencies; and select one of the transponder frequencies at which the satellite signal was detected for determining the antenna beam positioning value.

19. The vehicle communication system of claim 18, wherein the control subsystem is further configured to select the transponder frequency at which the detected satellite signal is at a maximum for determining the antenna beam positioning value.

20. A method to determine a pointing angle to a satellite in a satellite broadcast system using a broadcast spectrum comprising a plurality of transponder frequencies, the method comprising:

commanding an antenna to point to an expected direction associated with one of the transponder frequencies;

commanding a receiver to sequentially tune to selected transponder frequencies within the broadcast spectrum until a satellite signal is detected;

determining an antenna beam positioning value associated with the transponder frequency at which the satellite signal was detected; and determining a pointing error as a function of the expected direction and the determined antenna beam positioning value.

21. The vehicle communication system of claim 20, wherein the control subsystem is further configured to perform an electronic search for the satellite signal at a different elevation than the adjusted expected direction to the satellite.

22. The method of claim 20, wherein the pointing error is determined at least in part by calculating a difference between the determined antenna beam positioning value and an antenna beam positioning value associated with the expected direction.

23. The method of claim 20, further comprising, if the satellite signal is not detected, commanding the antenna to point to another direction.

24. The method of claim 23, wherein the other direction of the satellite is opposite the expected direction to which the antenna was initially pointed.

25. The method of claim 20, wherein determining the pointing error comprises determining the pointing error as a function of an angle discriminant measurement.

26. The method of claim 20, further comprising adjusting an expected direction to the satellite as a function of the pointing error.

27. The method of claim 26, further comprising performing an electronic search for the satellite signal at a different elevation than the adjusted expected direction to the satellite.

28. The method of claim 20, further comprising:

commanding the receiver to sequentially tune to the selected transponder frequencies to detect a satellite signal at a plurality of the selected transponder frequencies; and selecting one of the transponder frequencies at which the satellite signal was detected for determining the antenna beam positioning value.

29. The method of claim 28, wherein selecting one of the transponder frequencies comprises selecting the transponder frequency at which the detected satellite signal is at a maximum for determining the antenna beam positioning value.

30. A microprocessor-readable medium having microprocessor-executable instructions for:

commanding an antenna to point to an expected direction to a satellite in a satellite broadcast system using a broadcast spectrum comprising a plurality of transponder frequencies, the expected direction associated with one of the transponder frequencies;

commanding the receiver to tune to selected transponder frequencies within the broadcast spectrum until a satellite signal is detected;

determining an antenna beam positioning value associated with the transponder frequency at which the satellite signal was detected; and determining a pointing error as a function of the expected direction and the determined antenna beam positioning value.

31. The microprocessor-readable medium of claim 30, having further microprocessor-executable instructions for commanding the antenna to point to another direction opposite the expected direction to the satellite when the satellite signal is not detected.

32. The microprocessor-readable medium of claim 30, having further microprocessor-executable instructions for determining the pointing error as a function of an angle discriminant measurement.

33. The microprocessor-readable medium of claim 30, having further microprocessor-executable instructions for adjusting the expected direction to the satellite as a function of the pointing error.

34. The microprocessor-readable medium of claim 33, having further microprocessor-executable instructions for performing an electronic search for the satellite signal at a different elevation than the adjusted expected direction of the satellite.

35. The microprocessor-readable medium of claim 30, having further microprocessor-executable instructions for:

commanding the receiver to sequentially tune to the selected transponder frequencies to detect a satellite signal at a plurality of the selected transponder frequencies; and selecting one of the transponder frequencies at which the satellite signal was detected for determining the antenna beam positioning value.

36. The microprocessor-readable medium of claim 35, having further microprocessor-executable instructions for selecting the transponder frequency at which the detected satellite signal is at a maximum for determining the antenna beam positioning value.

* * * * *